US006993952B2

(12) United States Patent
Caporusso

(10) Patent No.: US 6,993,952 B2
(45) Date of Patent: Feb. 7, 2006

(54) MULTIPURPOSE HORIZONTAL PRESS HAVING A FIXED WORKPIECE-HOLDER FOR A TUBULAR WORKPIECE TO BE DRAWN OR TAPERED

(75) Inventor: Alessandro Caporusso, Piedimonte San Germano (IT)

(73) Assignee: New Tech S.r.l., Piedimonte San Germano (IT)

( * ) Notice: Subject to any disclaimer, the term of this patent is extended or adjusted under 35 U.S.C. 154(b) by 28 days.

(21) Appl. No.: 10/488,535

(22) PCT Filed: Sep. 7, 2001

(86) PCT No.: PCT/IT01/00465

§ 371 (c)(1),
(2), (4) Date: Mar. 4, 2004

(87) PCT Pub. No.: WO03/022481

PCT Pub. Date: Mar. 20, 2003

(65) Prior Publication Data

US 2004/0231392 A1 Nov. 25, 2004

(51) Int. Cl.
*B21D 41/02* (2006.01)

(52) U.S. Cl. ..... 72/318; 72/316; 72/370.1

(58) Field of Classification Search ..... 72/318, 72/316, 377, 287, 370.13, 370.1, 370.03, 72/370.02, 312, 317

See application file for complete search history.

(56) References Cited

U.S. PATENT DOCUMENTS

| | | | | |
|---|---|---|---|---|
| 470,239 | A | 3/1892 | Hall | |
| 818,337 | A | 4/1906 | Barnes | |
| 2,325,522 | A * | 7/1943 | Lauer et al. | 72/126 |
| 2,543,480 | A * | 2/1951 | Vaill | 72/21.6 |
| 3,610,016 | A * | 10/1971 | Bultman | 72/317 |
| 3,754,428 | A | 8/1973 | Alexoff | |
| 3,940,969 | A * | 3/1976 | Princehouse | 72/302 |
| 3,959,998 | A * | 6/1976 | Ross | 72/312 |
| 4,211,103 | A | 7/1980 | Grimaldo | |
| 4,383,429 | A * | 5/1983 | Ceccacci | 72/318 |
| 4,910,991 | A * | 3/1990 | Bertolette et al. | 72/370.03 |

FOREIGN PATENT DOCUMENTS

| | | |
|---|---|---|
| DE | 1 452 523 | 3/1969 |
| FR | 2 639 853 | 6/1990 |

* cited by examiner

*Primary Examiner*—Daniel C. Crane
(74) *Attorney, Agent, or Firm*—Young & Thompson

(57) ABSTRACT

A multipurpose horizontal press having a fixed workpiece-holder for a tubular workpiece to be drawn or tapered comprising a press body (1) surmounted by a worktable (2), having a superior surface (3) and an inferior surface (4), on the worktable (2) being positioned horizontally an operating hydraulic cylinder and, in correspondence with a through opening (70), a bridge (8) to which inferiorly a superior jaw (12) having its concavity facing downward, is rigidly connected. Opposite to the bridge (8) a support element (13) extends under the inferior surface (4) and supports a clamping hydraulic cylinder (14), having a rod (15) facing upward and provided with an inferior jaw (16), being sledge vertically inside the bridge (8) toward the superior jaw (12) and away from it.

12 Claims, 3 Drawing Sheets

MULTIPURPOSE HORIZONTAL PRESS HAVING A FIXED WORKPIECE-HOLDER FOR A TUBULAR WORKPIECE TO BE DRAWN OR TAPERED

BACKGROUND OF THE INVENTION

This invention relates to a multipurpose horizontal press having a fixed workpiece-holder for a tubular workpiece to be drawn or tapered.

The present multipurpose horizontal presses are provided with a hydraulic operating cylinder that is located horizontally on the worktable. The hydraulic operating cylinder is interlocked to a N/C unit. The rod of the hydraulic operating cylinder has at its end a work head on which the movable part of a die used in each single machining operation is fixed. The correspondent fixed part of the die is locked on the worktable, in which holes acting as seat for such a fixed part of the die are suitably made.

The present horizontal presses allow many deformation works such as pressing, bending, punching, shearing and further drawing and tapering. In the present multipurpose horizontal presses the fixed workpiece-holder is provided permanently with a result that the last one occupies uselessly space on the worktable that can be used for other operations when drawing or tapering must be performed.

Some horizontal presses have workpiece-holders for drawing and tapering completely removable from the press. However this implies longer machining times than with a permanent workpiece-holder.

The present invention aims to overcome the drawbacks resulting from the above mentioned need of locating a workpiece-holder for drawing and tapering on a worktable of a multipurpose press.

SUMMARY OF THE INVENTION

In particular, an object of the present invention is to avoid the drawback of a permanent presence of a workpiece-holder for drawing and tapering on a worktable.

Another object of the invention is to avoid the need of a complete removal of a workpiece-holder for drawing and tapering when this kind of machining is not required.

A further object of the invention is to reduce the machining times of drawing and tapering and to make easier the use of the horizontal press.

The present invention provides a multipurpose horizontal press having a fixed workpiece-holder for a tubular workpiece to be drawn or tapered comprising a press body surmounted by a worktable, having a superior surface and an inferior opposite surface, on the worktable being positioned horizontally an operating hydraulic cylinder with a rod having a work head which is pre-set for the mounting of a movable part of dies designed to co-operate with a fixed part of the same dies that is locked in holes made in the worktable, in a deformation work of material put between said fixed part and said movable part, characterized in that the horizontal press comprises in correspondence with a worktable through opening made in front of the work head opposite to the rod of the operating cylinder:

- a bridge extending over the superior surface of the worktable by means of a pair of uprights connected by a cross member to which inferiorly a superior jaw having its concavity facing downward, is rigidly connected;
- a support element extending under the inferior surface of the worktable opposite to the bridge;

- a clamping hydraulic cylinder, supported by the support element and having a rod facing upward and provided with an inferior jaw, having its concavity facing upward, being sliding vertically inside said bridge toward said superior jaw and away from it.

DETAILED BRIEF DESCRIPTION OF THE PREFERRED EMBODIMENTS

The invention will now be described with reference to a preferred embodiment thereof, although it must be understood that modifications can be made without departing from the spirit of the invention and referring to the figures of the accompanying drawings, in which.

Figure 1:
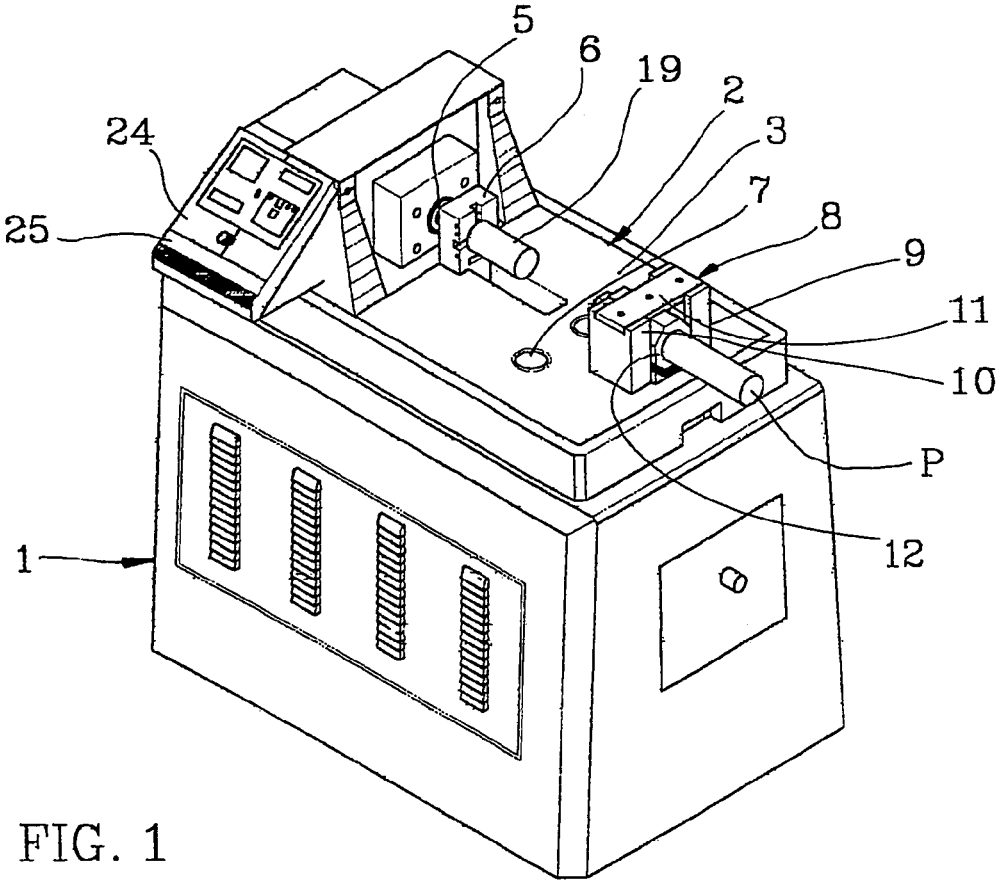
FIG. 1 shows a perspective view of a multipurpose horizontal press having a workpiece-holder assembled according to the invention.

Referring to the drawing, a horizontal press according to the invention is generally shown in FIG. 1. A body of the press, that is surmounted by a worktable 2, is designated as 1.

Figure 3:
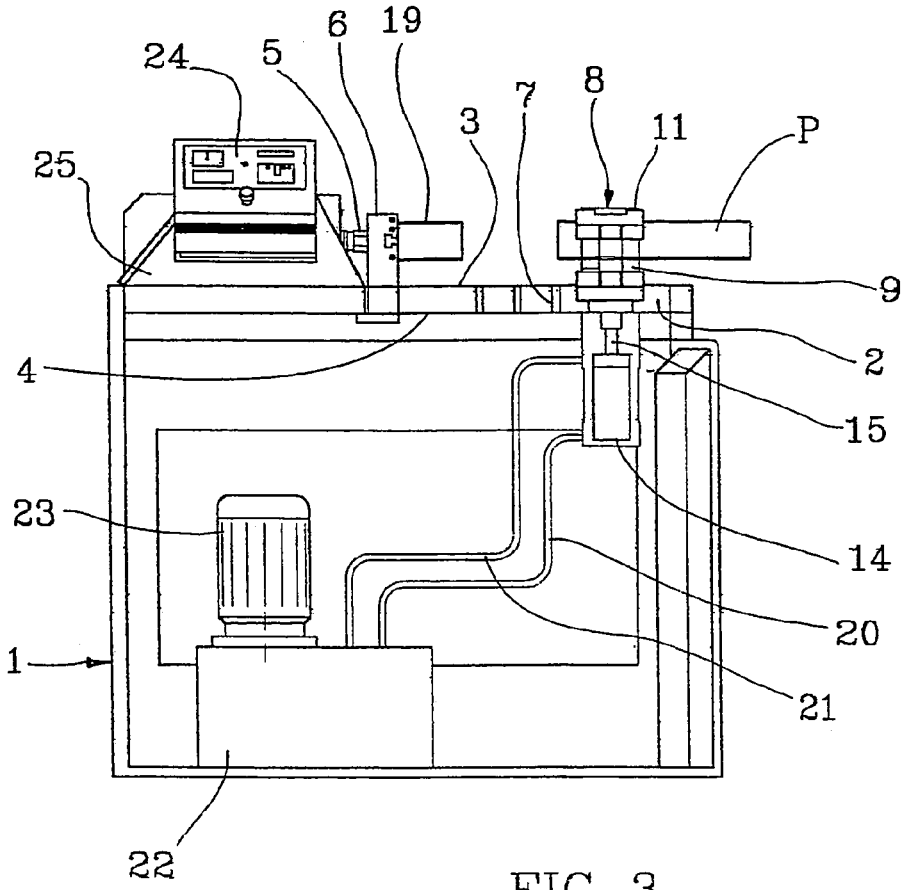
FIG. 3 shows a longitudinal cross section of the horizontal press of FIG. 1.

As shown in FIG. 3, the worktable 2 has a superior surface 3 and an opposed inferior surface 4.

An operating hydraulic cylinder whose rod 5 holding a work head 6 is positioned horizontally on the worktable 2. Generally the movable part of forming dies such as for pressing, bending, punching and shearing operations is connected to the work head 6. This movable part of the dies is designed to co-operate with a fixed part of the same dies, the last one being locked in holes made on the worktable such as those that are generally indicated as 7 in the figures. Both the movable and fixed parts of the forming dies are not shown in figures.

A workpiece to be subjected to a deformation work is put between the movable part and the fixed part on the horizontal press.

Figure 2:
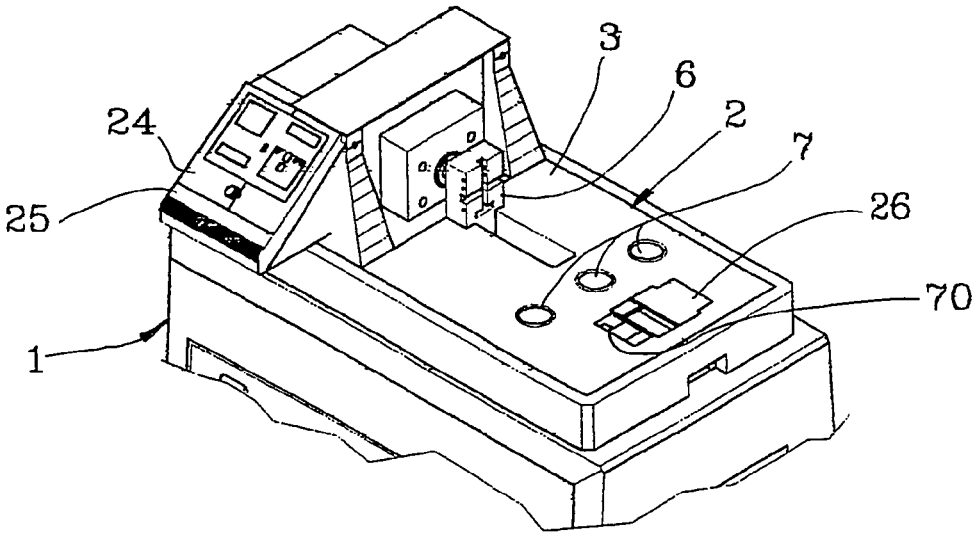
FIG. 2 shows a perspective view of the horizontal press of FIG. 1 having the workpiece-holder that is disassembled.
Figure 4:
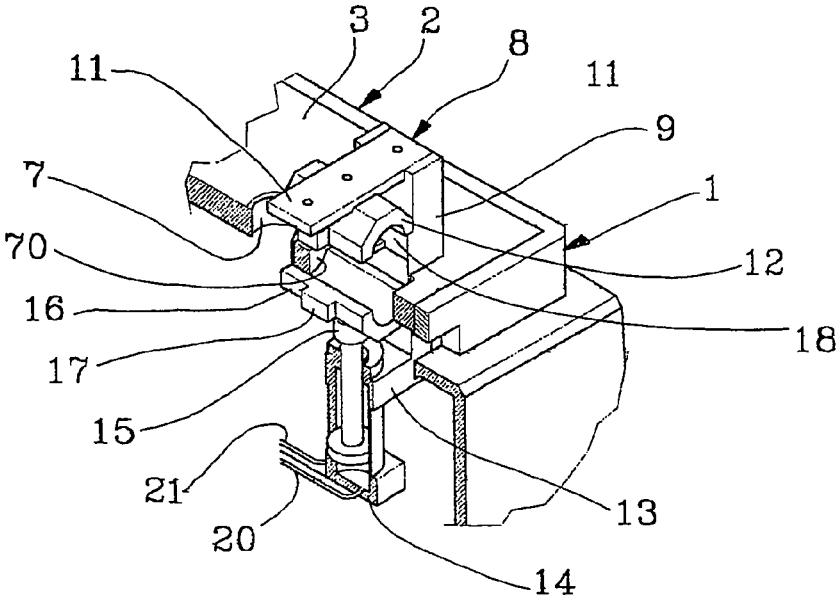
FIG. 4 shows in an enlarged fragmentary perspective view a longitudinal cross section of the horizontal press of FIG. 1.

According to the invention, in addition to the holes well known to the prior art, a through opening 70 that is better shown in FIGS. 2 and 4 is performed in the worktable 2.

The through opening 70 is made in worktable 2 in front of the work head 6 in the opposite side with respect the rod 5 of the operating cylinder.

A bridge 8 extending over the superior surface 3 of the worktable 2 is made in correspondence with the opening 70 in the worktable 2.

As shown in particular in FIG. 1, the bridge 8 is made of a pair of uprights 9 and 10 connected by a cross member 11. The uprights 9, 10 are connected by screws to the worktable in not shown but conventionally manner. The cross member 11, in turn, is fixed on the uprights, as shown in FIGS. 1 and 4 or alternatively is made integral with them.

The cross member 11 has in its inferior side a jaw 12 facing downward with its concavity.

A support element generally designated as 13 is fixed under the worktable 2, opposite to the bridge 8.

The support element 13 supports a hydraulic cylinder 14 clamping the present workpiece-holder. The clamping hydraulic cylinder 14 has its rod 15 extending upward. The rod 15 in its free end has an inferior jaw 16 that is a mirror image of the superior jaw 12, i.e. having its a concavity facing upward.

By virtue of a preferably releasable connection of the inferior jaw 16 with the rod 15 of the clamping hydraulic cylinder 14, the inferior jaw 16 can slide vertically toward the superior jaw 12 and away from it. The vertical reciprocating motion of the inferior jaw 16 is assured by prismatic guides as shown by a projection 17 and a sliding recess designated as 18 in FIG. 4, that is correspondingly sized and shaped to the projection 17.

The inferior jaw 16 has usually a semicylindrical concavity with the same radius of the superior jaw 12, in order to clamp a tubular workpiece P to be drawn or tapered by a matrix indicated as 19, that is assembled for this operation onto the work head 6, as shown in FIGS. 1 and 3.

As better shown in FIG. 3, the clamping hydraulic cylinder 14 is driven through feed/discharge conducts 20, 21 that are connected to a hydraulic unit 22, to drive a hydraulic motor 23. There is a control board 24 of a N/C unit 25, as shown in FIG. 3.

When any drawing or tapering operation is not performed by the multipurpose horizontal press, in order to use as far as possible the worktable, the bridge 8 is disassembled. Plates covering the through opening 70, such as those designated as 26 in FIG. 2 for example, can be applied onto the worktable. The inferior jaw 16 can remain connected to the rod 15 of the clamping hydraulic cylinder.

The bridge 8 can be used with jaws having different sizes and radius. In the operation of the clamping hydraulic cylinder 14 the thrust from the operating cylinder through its rod 15 can be taken up by the uprights 9 and 10 of the bridge 8.

As above mentioned, the uprights 9 and 10 and the cross member 11 can be integral.

Figure 5:
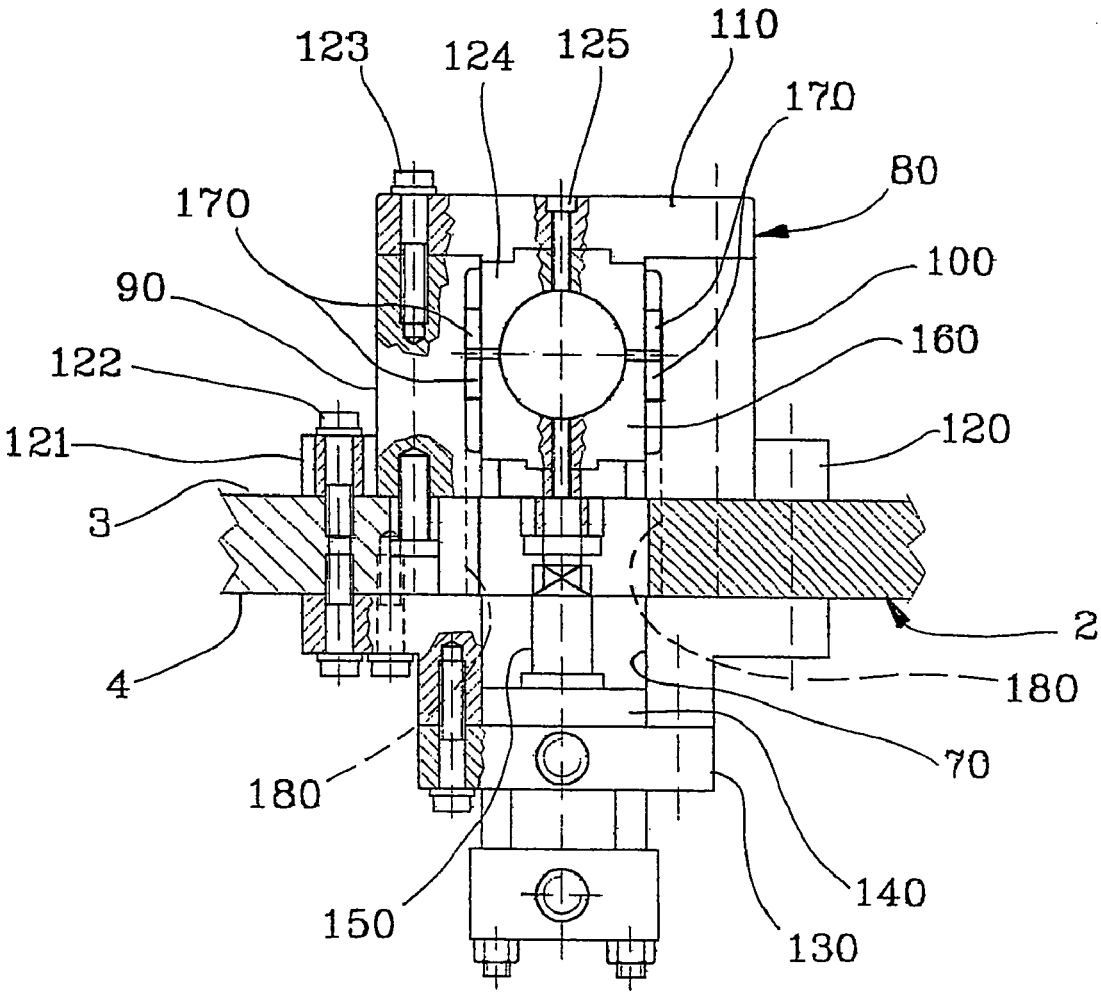
FIG. 5 shows in an enlarged fragmentary cross-sectioned front view an embodiment of the workpiece-holder according to the invention.

In FIG. 5 in which parts corresponding to those in the other figures are indicated with like or similar reference numbers an embodiment of bridge 80, which is connected to worktable 2 by releasable coupling means in particular threaded coupling means, is shown.

A bridge 80 extending over the opening 70 in the worktable 2 is made of a pair of uprights 90 and 100 connected by a cross member 110. Blocks 120, 121 connected by screws to the worktable 2 such as the one designated as 122, are joined laterally by welding to the uprights 90, 100. The cross member 110 is fixed on the uprights by screws, such as the one designated as 123.

A support element generally designated as 130, that is connected likely by screws to the worktable 2, is fixed under the worktable 2, opposite to the bridge 80.

The support element 130 supports a hydraulic cylinder 140 clamping the present workpiece-holder. The rod 150 of the clamping hydraulic cylinder 140 has an inferior jaw 160. The vertical reciprocating motion of the inferior jaw 160 is assured by prismatic guides constituted by opposite projections 170 and a sliding recesses 180.

The horizontal thrust applied by the operating cylinder during the drawing or tapering operation that is not used to deform the workpiece, is discharged on the prismatic guides 170–180.

What is claimed is:

1. Multipurpose horizontal press having a fixed workpiece-holder for a tubular workpiece to be drawn or tapered comprising:

a press body surmounted by a worktable, having a superior surface and an inferior opposite surface , on the worktable, positioned horizontally, an operating hydraulic cylinder with a rod having a work head which is pre-set for the mounting of a movable part of dies designed to co-operate with a fixed part of the same dies that is locked in holes made in the worktable , in a deformation work of material put between said fixed part and said movable part; and in correspondence with a worktable through opening made in front of the work head opposite to the rod of the operating cylinder:

a bridge extending over the superior surface of the worktable by means of a pair of uprights connected by a cross member to which inferiorly a superior jaw having its concavity facing downward, is rigidly connected;

a support element extending under the inferior surface of the worktable opposite to the bridge;

a clamping hydraulic cylinder, supported by the support element and having a rod facing upward and provided with an inferior jaw, having its concavity facing upward, being slidable vertically inside said bridge toward said superior jaw and away from said superior jaw into said through opening.

2. Multipurpose horizontal press according to claim 1, wherein said bridge is connected to the worktable by releasable coupling means.

3. Multipurpose horizontal press according to claim 2, wherein said releasable coupling means are threaded coupling means.

4. A multipurpose horizontal press, comprising:

a press body;

a worktable mounted on said press body, said worktable having a superior surface with holes therein and a through opening therethrough, and an opposite inferior surface;

an operating hydraulic cylinder mounted horizontally on said worktable, said operating hydraulic cylinder having a first rod with a work head which is pre-set for mounting a movable part of dies designed to co-operate with a fixed part of the dies that is locked in the holes of the worktable;

a bridge extending over the superior surface of the worktable and having a pair of uprights connected by a cross member;

a first jaw connected to an inferior side of said cross member and having a concave portion facing downward;

a support element extending beneath the inferior surface of the worktable opposite to the bridge;

a clamping hydraulic cylinder, supported by said support element and having a second rod facing upward and provided with a second jaw, said second jaw having a concave portion facing upward and being vertically slidable between a first position inside said bridge, toward said first jaw and a second position beneath said superior surface, away from said first jaw.

5. The multipurpose horizontal press according to claim 4 further comprising means for releasably coupling said bridge directly to said worktable.

6. The multipurpose horizontal press according to claim 5, wherein said means for releasably coupling are threaded.

7. The multipurpose horizontal press according to claim 5, further comprising a plate that covers said through opening when said bridge is decoupled from said worktable.

8. The multipurpose horizontal press according to claim 4, wherein said through opening comprises slots and said second jaw further comprises guides slidable within said slots.

9. The multipurpose horizontal press according to claim 4, wherein said pair of uprights each comprise slots and said second jaw further comprises guides slidable within said slots.

10. A multipurpose horizontal press, comprising:

a press body;

a worktable mounted on said press body, said worktable having a superior surface with a through opening and an opposite inferior surface;

an operating hydraulic cylinder mounted horizontally on said worktable;

a bridge extending over the superior surface of the worktable and having a pair of uprights connected by a cross member;

a first jaw rigidly connected to an inferior side of said cross member and having a concave portion facing downward;

a support element extending beneath the inferior surface of the worktable opposite to the bridge;

a clamping hydraulic cylinder, supported by said support element and having a rod facing upward and provided with a second jaw, said second jaw having a concave portion facing upward and being vertically slidable between a first position inside said bridge and a second position beneath said superior surface.

11. The multipurpose horizontal press according to claim 10 further comprising means for releasably coupling said bridge to said worktable.

12. The multipurpose horizontal press according to claim 11, further comprising a plate that covers said through opening when said bridge is decoupled from said worktable.

* * * * *